US005549055A

United States Patent [19]

Kusch

[11] Patent Number: 5,549,055

[45] Date of Patent: Aug. 27, 1996

[54] UNDERFRAME FOR TABLETOPS FOR SINGLE AND MULTIPLE TABLES

[76] Inventor: Dieter Kusch, Lieserfeld 27, 59969 Hallenberg, Germany

[21] Appl. No.: 380,659

[22] Filed: Jan. 30, 1995

[30] Foreign Application Priority Data

Jan. 28, 1994 [DE] Germany ..... 44 02 520.3
Oct. 10, 1994 [DE] Germany ..... 44 36 166.1

[51] Int. Cl.[6] ..... A47B 3/06

[52] U.S. Cl. ..... 100/153; 108/115; 108/153

[58] Field of Search ..... 108/154, 157, 108/153, 180, 192, 193, 165, 121, 125, 129, 130, 131, 132; 248/188, 188.1

[56] References Cited

U.S. PATENT DOCUMENTS

| | | | |
|---|---|---|---|
| 1,792,406 | 2/1931 | Tomlinson | 108/157 |
| 2,175,572 | 10/1939 | Ruhl | 108/157 X |
| 3,217,673 | 11/1965 | Knoblock | 108/157 |
| 3,451,362 | 6/1969 | Ostling et al. | 108/153 X |
| 3,504,877 | 4/1970 | Lyon, Sr. | 248/188 |
| 4,283,033 | 8/1981 | Bauer | 248/188 |
| 4,287,837 | 9/1981 | Bayles | 108/154 |
| 4,944,235 | 7/1990 | Jahnke et al. | 108/154 X |
| 5,056,746 | 10/1991 | Parsons et al. | 248/188 |
| 5,241,914 | 9/1993 | Korb | 248/188.1 X |

FOREIGN PATENT DOCUMENTS

| | | | |
|---|---|---|---|
| 0364782 | 4/1990 | European Pat. Off. . | |
| 1295397 | 5/1962 | France | 108/157 |
| 1315959 | 12/1962 | France . | |
| 92015492 | 5/1992 | Germany . | |

*Primary Examiner*—Jose V. Chen
*Attorney, Agent, or Firm*—Young & Thompson

[57] ABSTRACT

Main components of the underframe for a tabletop (2) are a mounting plate (19), on which a leg column is fastened, two mounting rails (17) arranged on the underside (5) of the tabletop (2) at a distance from and parallel to one another, and two clamping devices (7) clamp the mounting plate (19) firmly to a mounting rail (17). The mounting rails (17) are L-cast profiles with a short reinforcing leg (17*a*) and a long holding leg (17*b*), fastened to the tabletop underside (5) with clamping studs (17*c*): or a molded-on clamping leg, offset downwardly. Clamping studs (17*c*) or the clamping leg, directed toward the center of the tabletop, form with the holding leg (17*b*) a slot (18) to move the tabletop (2) onto outer edges (19*a*) of the mounting plate (19) offset upwardly or to extend the mounting plate. On the mounting plate (19), two clamping devices (7) with a toggle joint (20) for actuating a locking rod (21) are attached at a distance, the rod fitting in locking position (21') with its clamping end (22) into a clamping gap (23), which is formed by clamping studs (17*c*), each in the locking position, or the clamping leg of one of two mounting rails (17) and outer edge (19*a*) of mounting plate (19), arranged at a distance over studs (17*c*) or the clamping leg.

11 Claims, 12 Drawing Sheets

Fig. 1
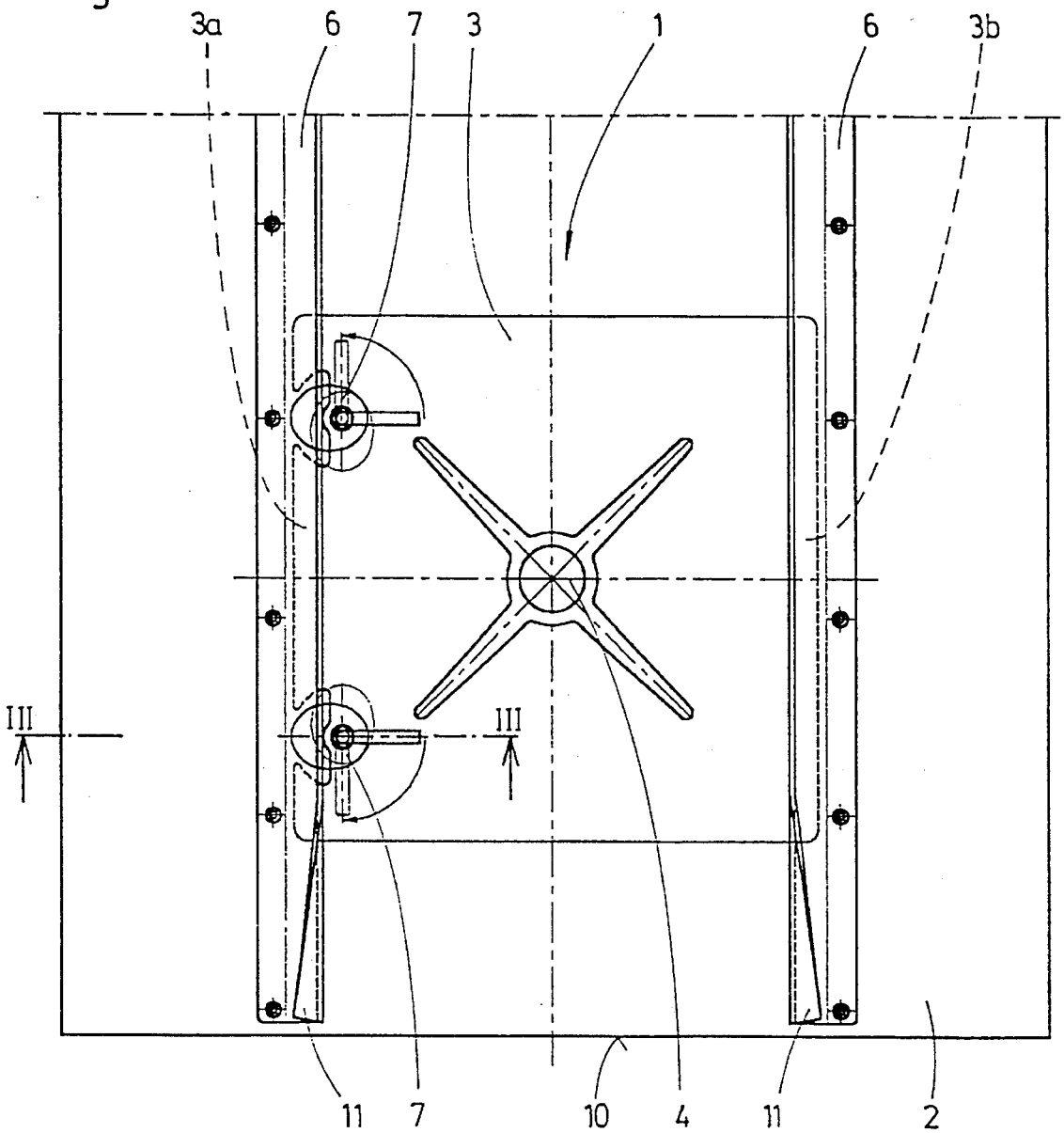
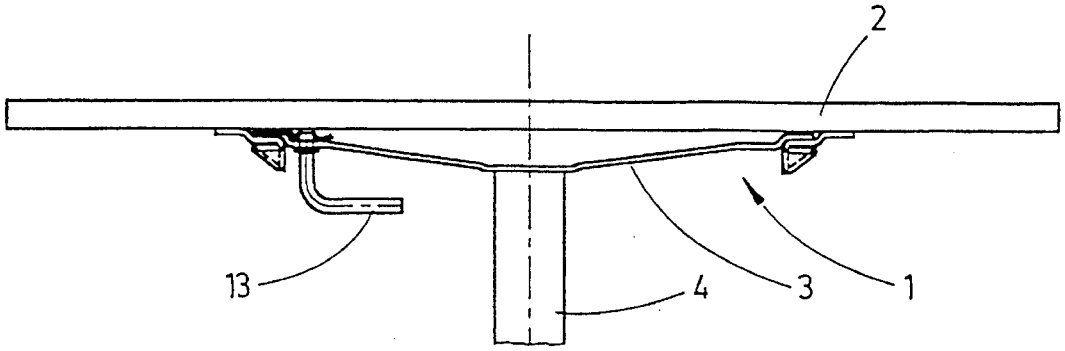
Fig. 2

UNDERFRAME FOR TABLETOPS FOR SINGLE AND MULTIPLE TABLES

The invention relates to an underframe for tabletops for single and multiple tables, with one or more legs or pedestals, which is or are attached to a mounting plate fastened under the tabletop.

DE 92 01 549 U1 describes a generic underframe, which comprises two pedestals with two outer pipes, to which tabletops are fastened with clamps. In the outer pipes are located inner pipes, movable telescopically, which can be pulled out from the outer pipes to extend a table with an extension tabletop, to set up a table with table leaves or to suspend writing desk containers, and the maximum pull-out length and the maximum slide-in length are limited by stops.

The design of this known underframe for tabletops is comparatively expensive for a piece of furniture to be mass-produced.

The object of the invention is to develop a generic underframe for tabletops with a design geared to mass production and simple assembly.

The underframe for tabletops according to the invention represents an extremely simple design suitable for economical mass production. The underframe is distinguished by maximum safety mounting plate of the frame with the tabletop. The underframes with the mounting plates and the tabletops with the mounting rails form a system with which the single and multiple tables for meetings in multipurpose spaces corresponding to the respective requirements and when using corner elements over 45° and 90° any table formations can be set up very quickly, in the connection of two tabletops the mounting plate of the underframe lying in the center under the front sides of the tabletop joint. By the infinitely variable movability of the mounting plates with a central leg or a pedestal under the tabletop, a writing desk can be produced in a simple way with office containers designed as roller containers, which are equipped with drawers, pigeonholes, filing trays and the like. In equipping the underframe with a leg or legs, which can swivel under the mounting plate, tables can be stored in a simple and space-saving manner. Finally, the underframe makes possible complete leg-room when equipped with a central leg.

The invention is explained below based on embodiments shown in drawings. There is shown in:

FIG. 1 is a lower view of a tabletop equipped with the underframe according to the invention;

FIG. 2 is a front view of the underframe with tabletop according to FIG. 1;

Figure 3:
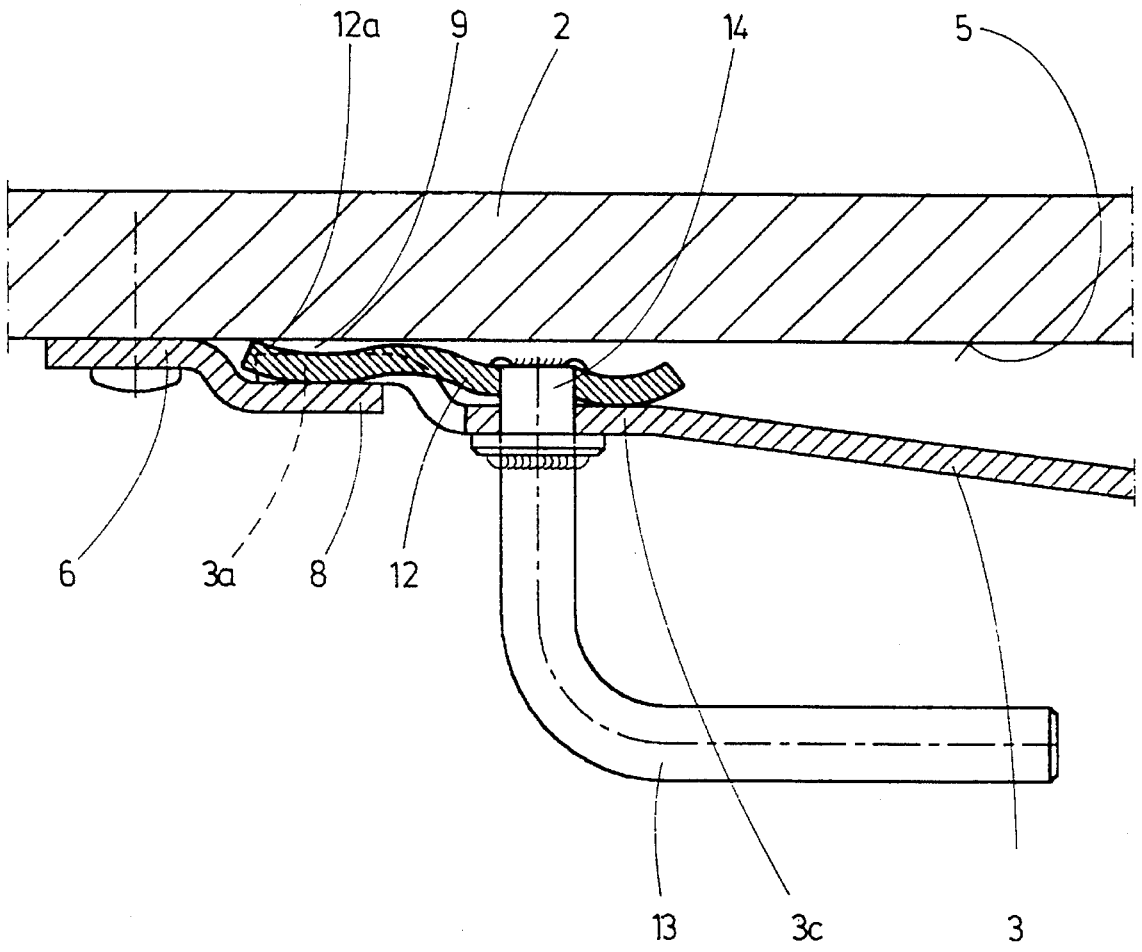
FIGS. 3 and 4 are transverse sections along line III—III of FIG. 1 of a clamping element used in the underframe as well as a lower view of the clamping element in enlarged representation.
Figure 4:
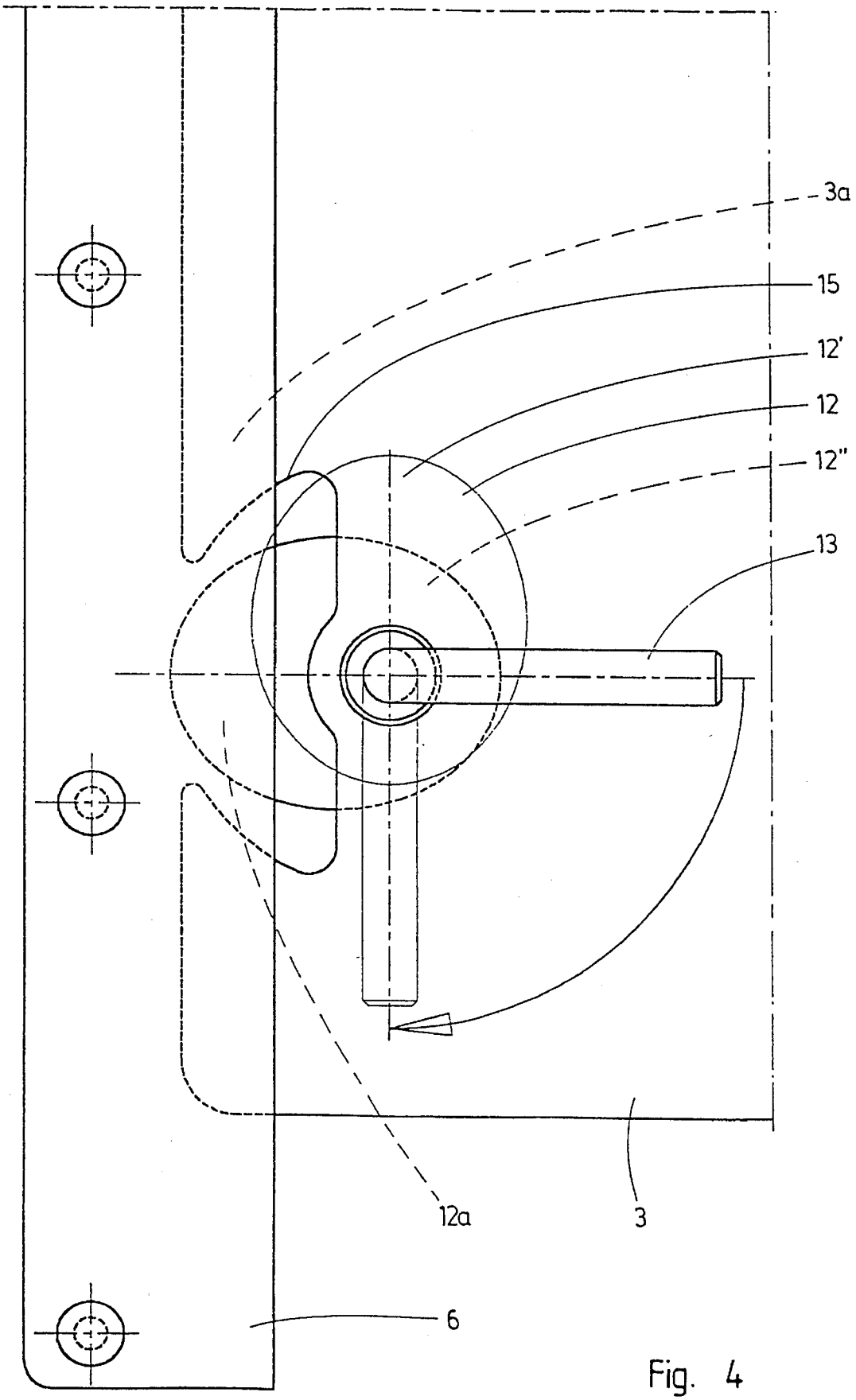

Main components of underframe 1 represented in FIGS. 1 to 4 for a self supporting tabletop 2 with a rectangular or square shape are a mounting plate 3, on which a leg column or a central leg 4 is fastened, two mounting rails 6 arranged on underside 5 of tabletop 2 at a distance and parallel to one another to move tabletop 2 onto mounting plate 3 or insert mounting plate 3 as well as two clamping devices 7 to clamp mounting plate 3 firmly to mounting rail 6.

Mounting rails 6 comprise a Z-profile, and legs 8 of mounting rails 6 directed inwardly toward one another form with tabletop underside 5 gaps 9 to hold two opposite edges 3*a*, 3*b* of mounting plate 3.

Mounting rails 6 end shortly before tabletop edges 10 on the front side, and ends 11 of mounting rails 6 are folded under to avoid leg injuries.

Two clamping devices 7, which are designed as oval clamping disks 12 with an S-profile, are pivotally mounted on edge section 3*c* of mounting plate 3, connecting to an extending edge 3*a*, the plate being arranged at a distance under tabletop 2. Clamping disks 12 are attached on one end 14 of one swivel lever 13 having an end guided through mounting plate 3 and fixed in this plate, to rotate clamping disks 12 from release position 12' into clamping position 12" in gap 9 between tabletop underside 5 and inner leg 8 of mounting rail 6, in the area of rotation of clamping disks 12 extending edge 3*a* of mounting plate 3 having corresponding recesses 15.

Section 12*a* of clamping disk 12 rotatable like a rolling key in gap 9 between tabletop underside 5 and inner leg 8 of mounting rail 6 produces double clamping-holding of mounting plate 3 on mounting rail 6; on the one hand, extending edge 3*a* of the mounting plate is braced against inner leg 8 of mounting rail 6 and on the other hand, section 12*a* of clamping disk 12 attached rotatably on edge section 3*c* of mounting plate 3 is clamped firmly between tabletop underside 5 and inner leg 8 of mounting rail 6.

In a modification of the described tabletop underframe 1, clamping disks 12 can be attached on both extending edges 3*a*, 3*b* of mounting plate 3.

Figure 5:
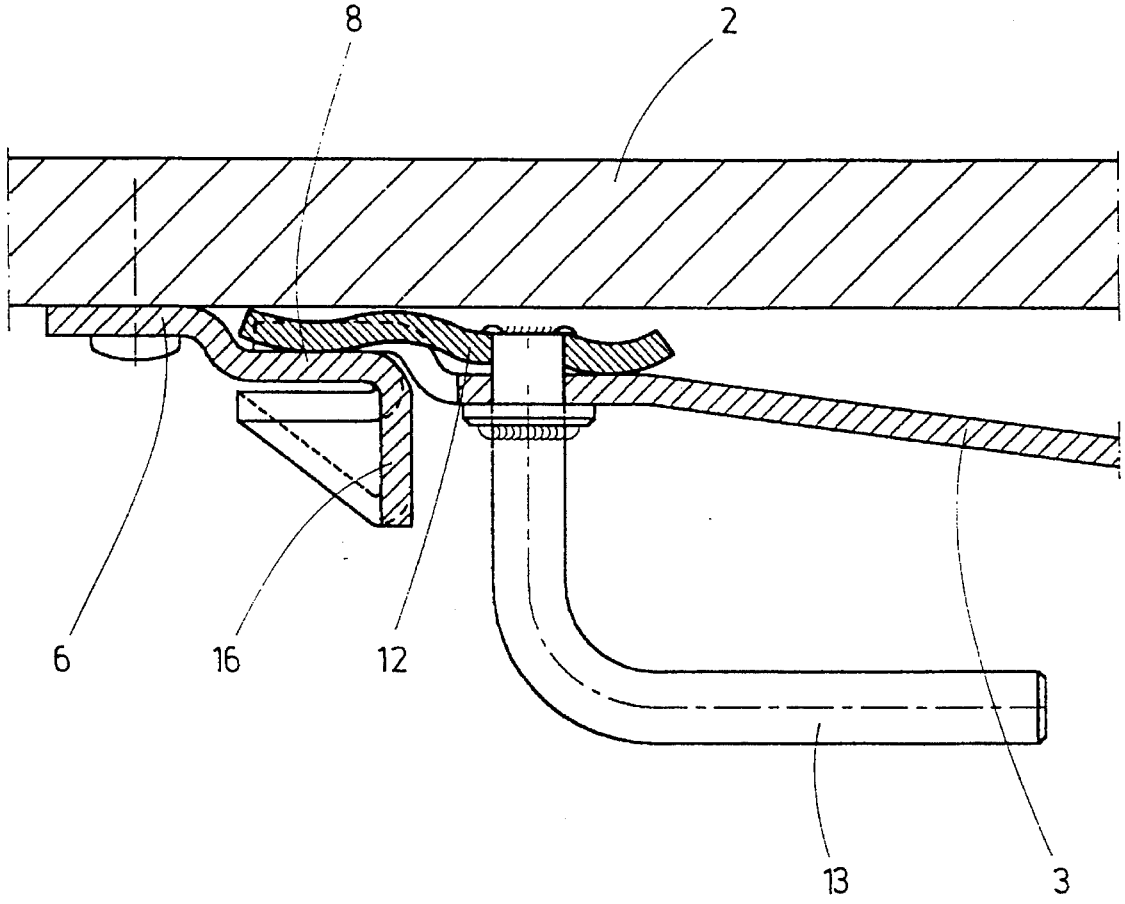
FIG. 5 is a transverse section of a clamping element of an underframe corresponding to FIG. 3 for a nonself-supporting tabletop.
Figure 6:
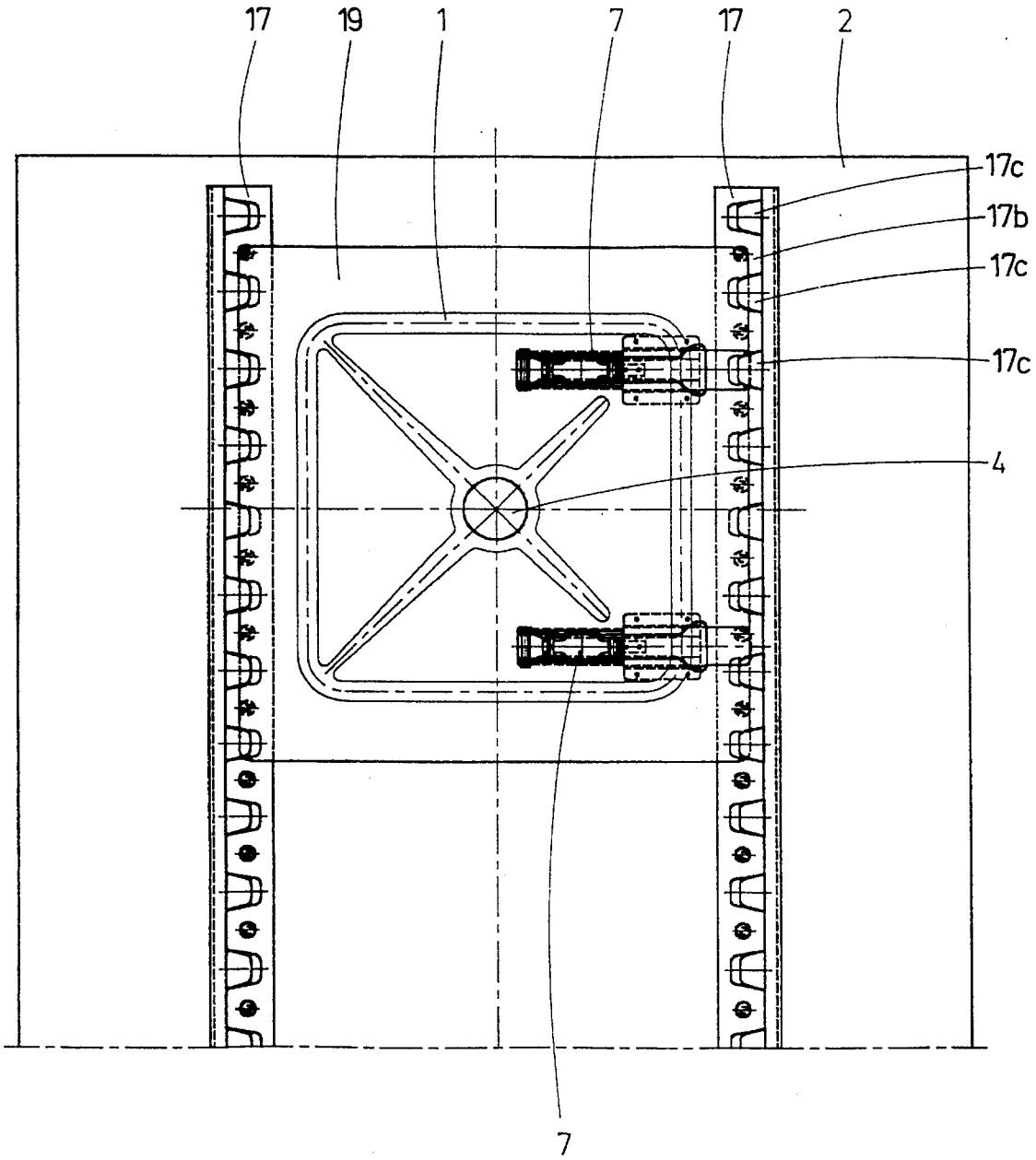
FIG. 6 is a lower view of a tabletop, which is equipped with the underframe, according to the invention, in a second embodiment.
Figure 7:
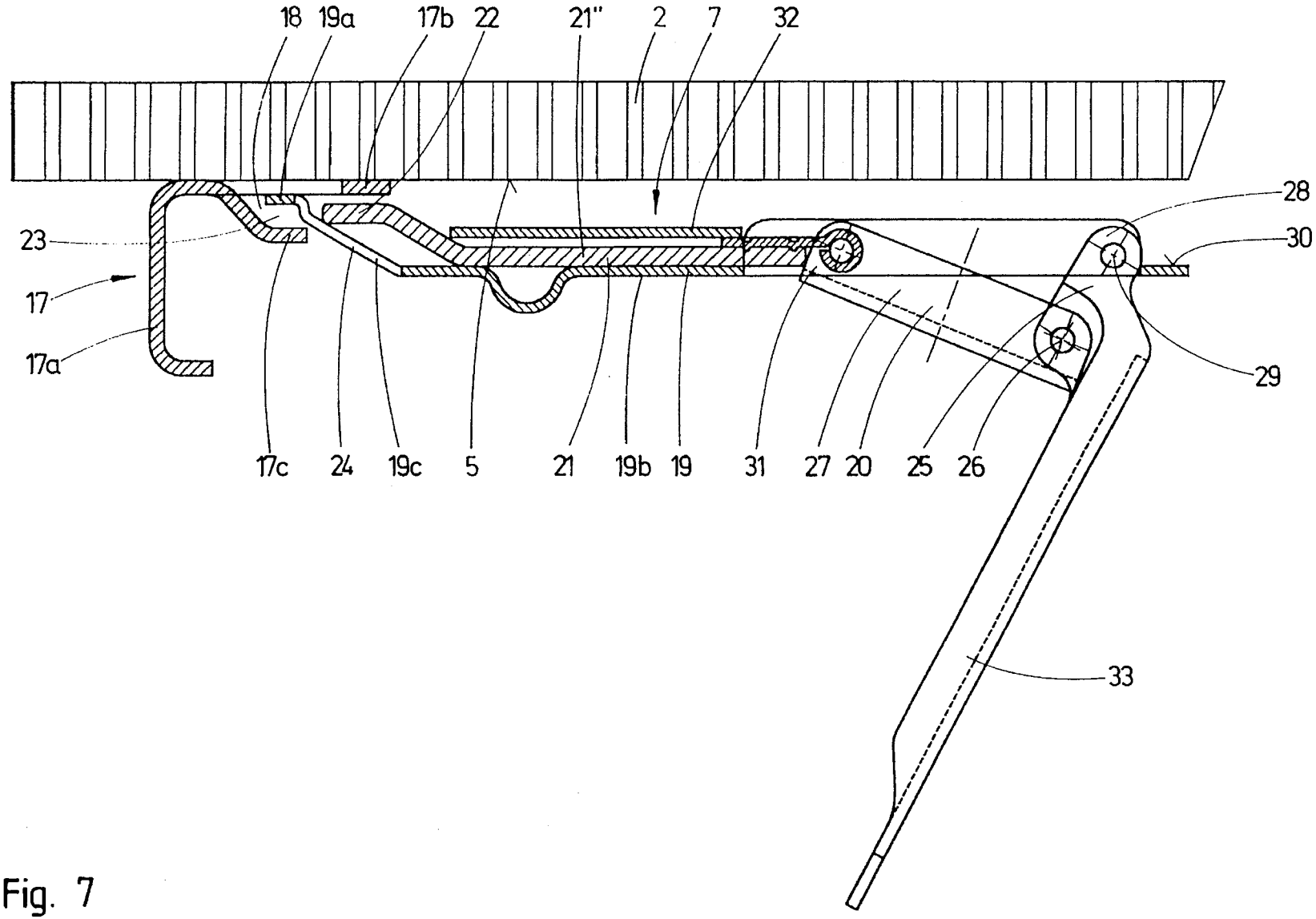
FIGS. 7 and 8 are transverse sections of a clamping device used in the underframe according to FIG. 6 in the release and the locking position.
Figure 8:
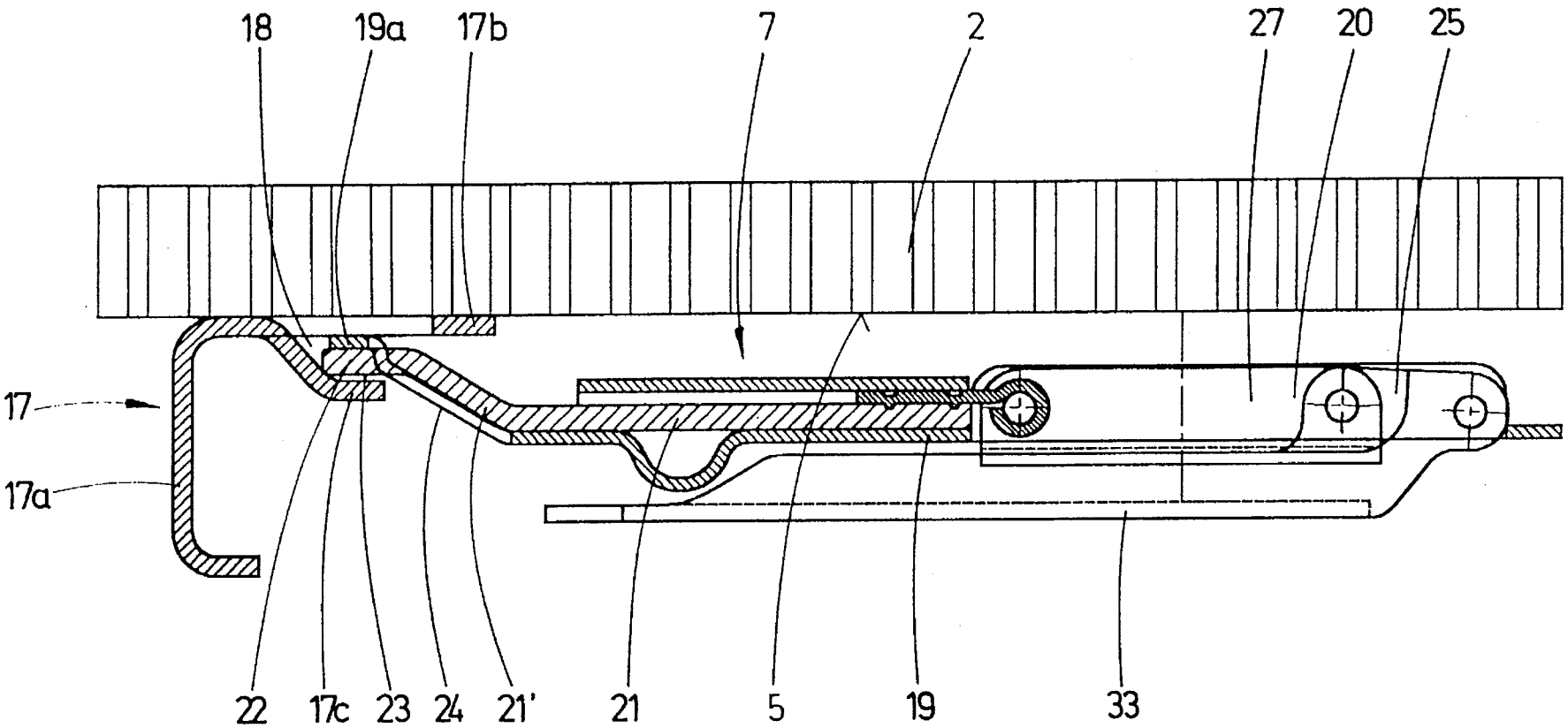
Figure 9:
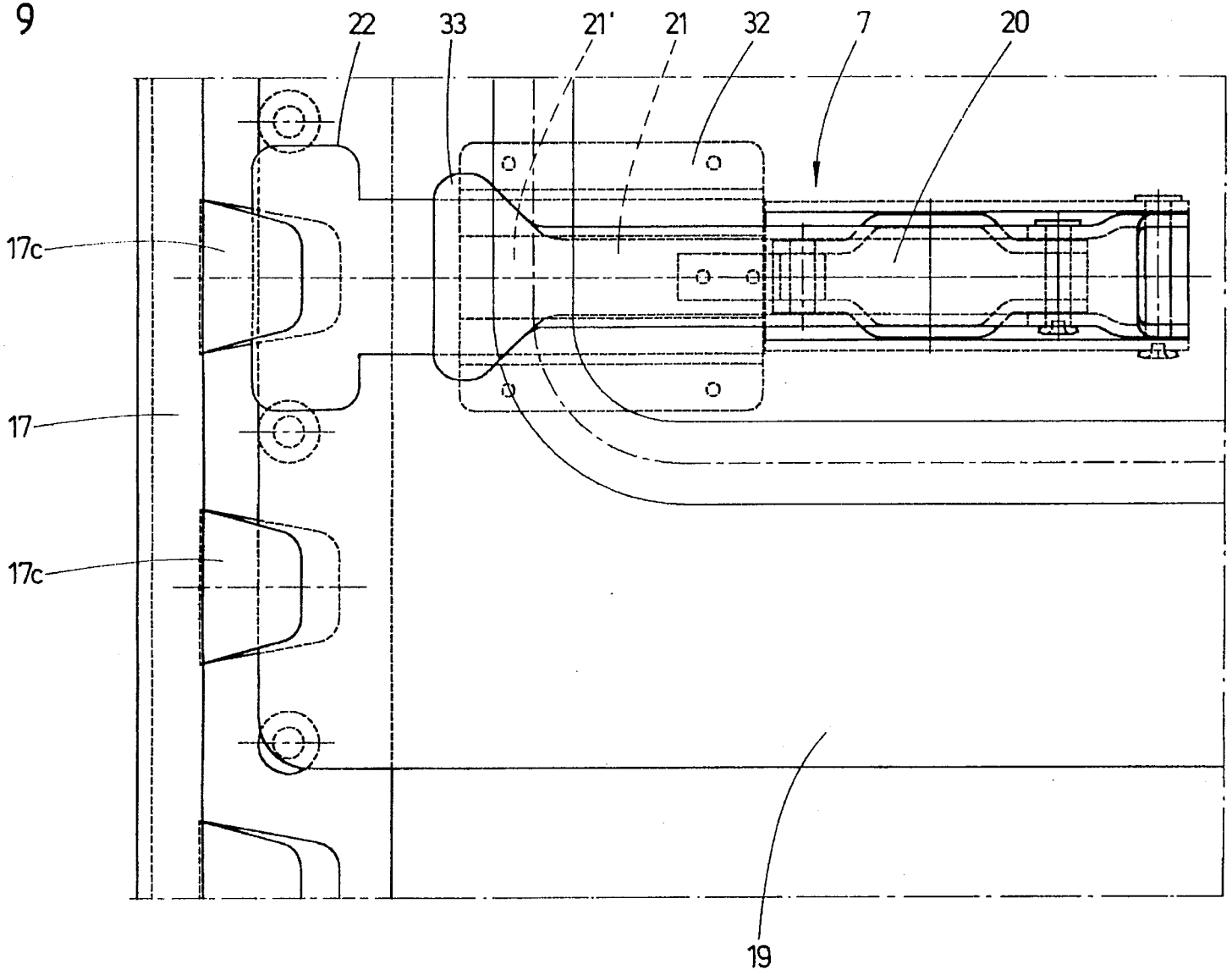
FIG. 9 is a lower view of the clamping device.

Underframe 1 represented in FIG. 5 in cutaway section in the area of clamping disk 12 is intended for a light, nonself-supporting tabletop 2. In the case of this underframe, mounting rails 6 comprise reinforcing leg 16 bent downward from inner leg 8.

In tabletop 3 represented in FIGS. 6 to 10, mounting rails 17 are designed as L-cast profiles made of steel with a short reinforcing leg 17*a* and a long holding leg 17*b*, fastened to tabletop underside 5, with clamping studs 17*c*, offset released downward, which are directed toward the center of the tabletop and form with holding leg 17*b* a slot 18 to move tabletop 2 onto outer edges 19*a* of mounting plate 19 or for extending the mounting plate.

On mounting plate 19, two clamping devices 7 with a toggle joint 20 for actuating a locking rod 21 are attached at a distance, the rod fitting in locking position 21' with its clamping end 22, designed as a clamping ring, nonpositively and positively into a clamping gap 23, which is formed by clamping studs 17*c* of one of two mounting rails 17 respectively in the locking position and outer edge 19*a* of mounting plate 19, arranged at a distance over studs 17*c*, on which mounting rail 17 is supported with holding leg 17*b*.

Mounting plate 19 comprises a center section 19*b*, which merges into two edge sections 19*c* directed obliquely upward, pointing outward, of which in each case an outer, horizontally extending edge or moving edge 19*a* is offset upward. In edge section 19*c* of mounting plate 19 adjacent to two clamping devices 7, two through-openings 24 are arranged for locking rods 21.

One lever 25 of toggle joint 20 for actuating locking rods 21 of two clamping devices 7 is coupled with its end 28 facing away from connecting hinge 26 of two levers 25, 27, at a fixed point 29 on top side 30 of mounting plate 19. Locking rod 21 movable in a slide bar 32 on top side 30 of mounting plate 19 is connected to end 31 of other lever 27 of toggle joint 20 facing away from connecting hinge 26. On lever 25 of toggle joint 20 securely connected to mounting plate 19, is handle 33 with which locking rod 21 can be moved from released position 21" to locking position 21' to clamp tabletop 2 firmly on mounting plate 19 of underframe 1, and the clamping connection between tabletop and mounting plate can again be released.

To be able to clamp tabletop 2 firmly in any desired position on mounting plate 19 of table underframe 1, it is possible, in a modification of the previously described frame embodiment, to make clamping studs 17*c* on mounting rails 17 correspondingly broader instead of a clamping end 22 of locking rods 21 widened like a bracket.

Figure 10:
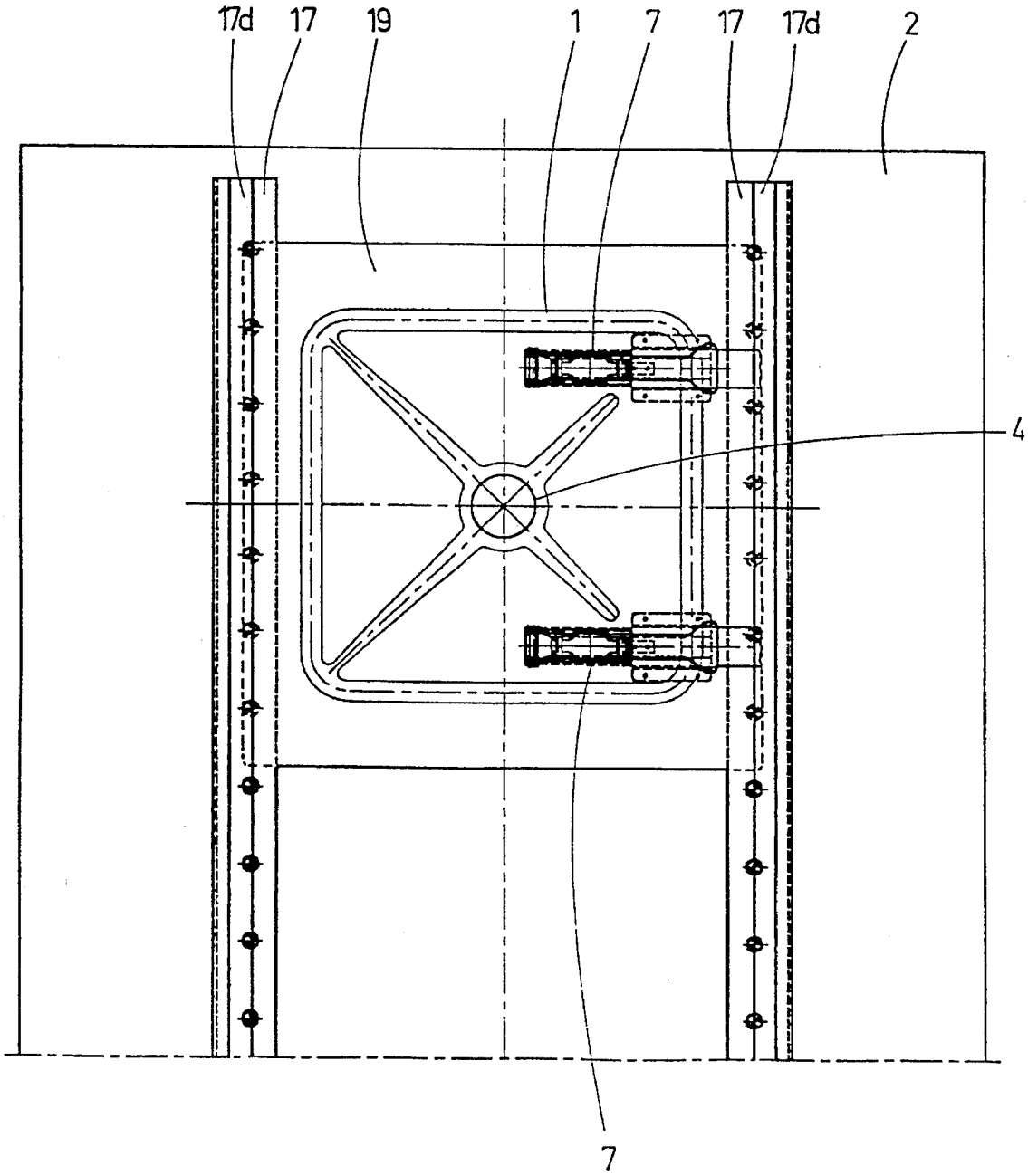
FIG. 10 is a lower view of a tabletop with an underframe in a third embodiment.
Figure 11:
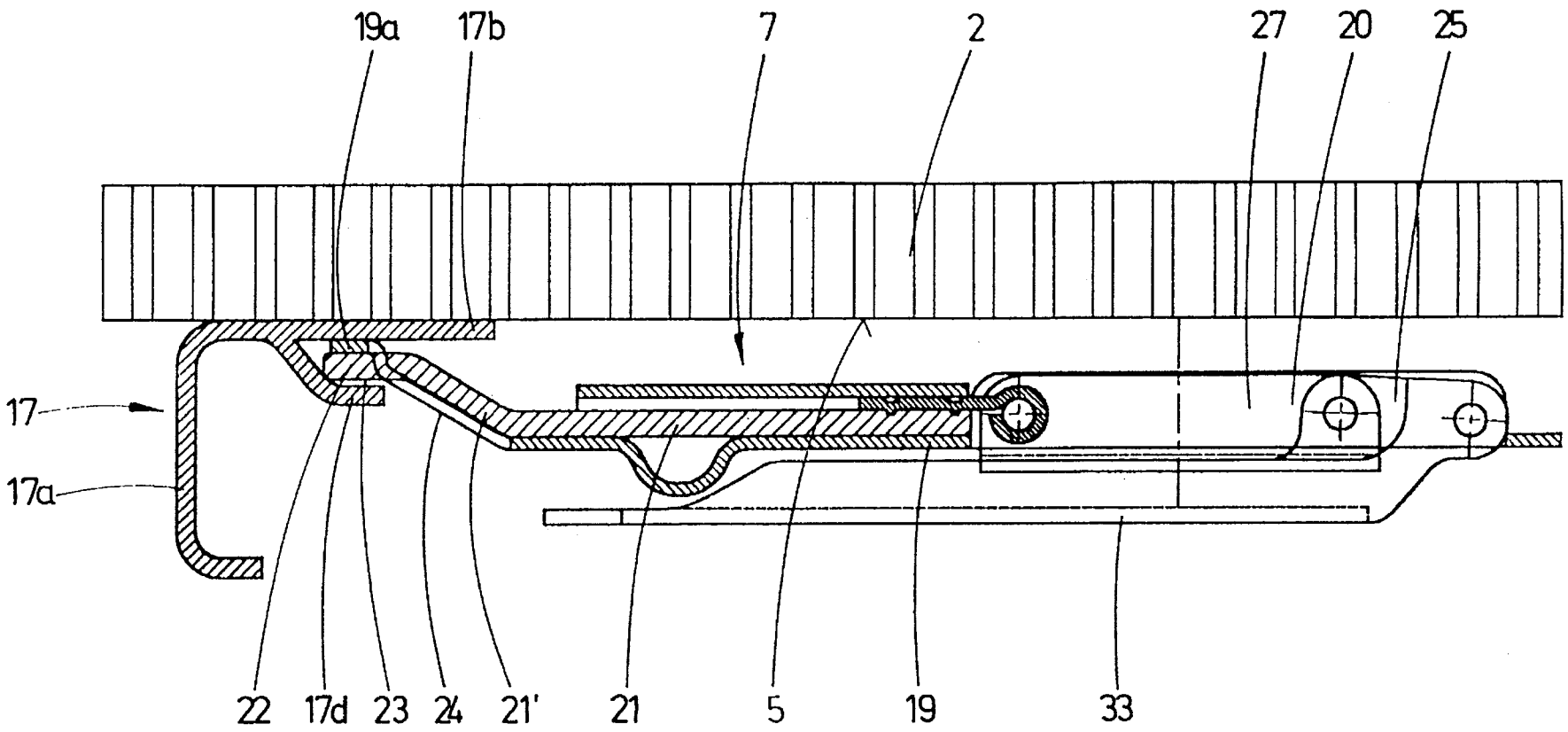
FIG. 11 is a transverse section of the underframe according to FIG. 10 with the clamping device in the locking position.

In underframe 1 represented in FIGS. 10 and 11, mounting rails 17 produced from aluminum-casting profiles have an L-profile with a short reinforcing leg 17*a* and a long holding leg 17*b*, on which a clamping leg 17*d*, passing through over the entire length of the profile and offset downward, is molded. No widened clamping end is necessary in this underframe 1 for locking rod 21.

Figure 12:
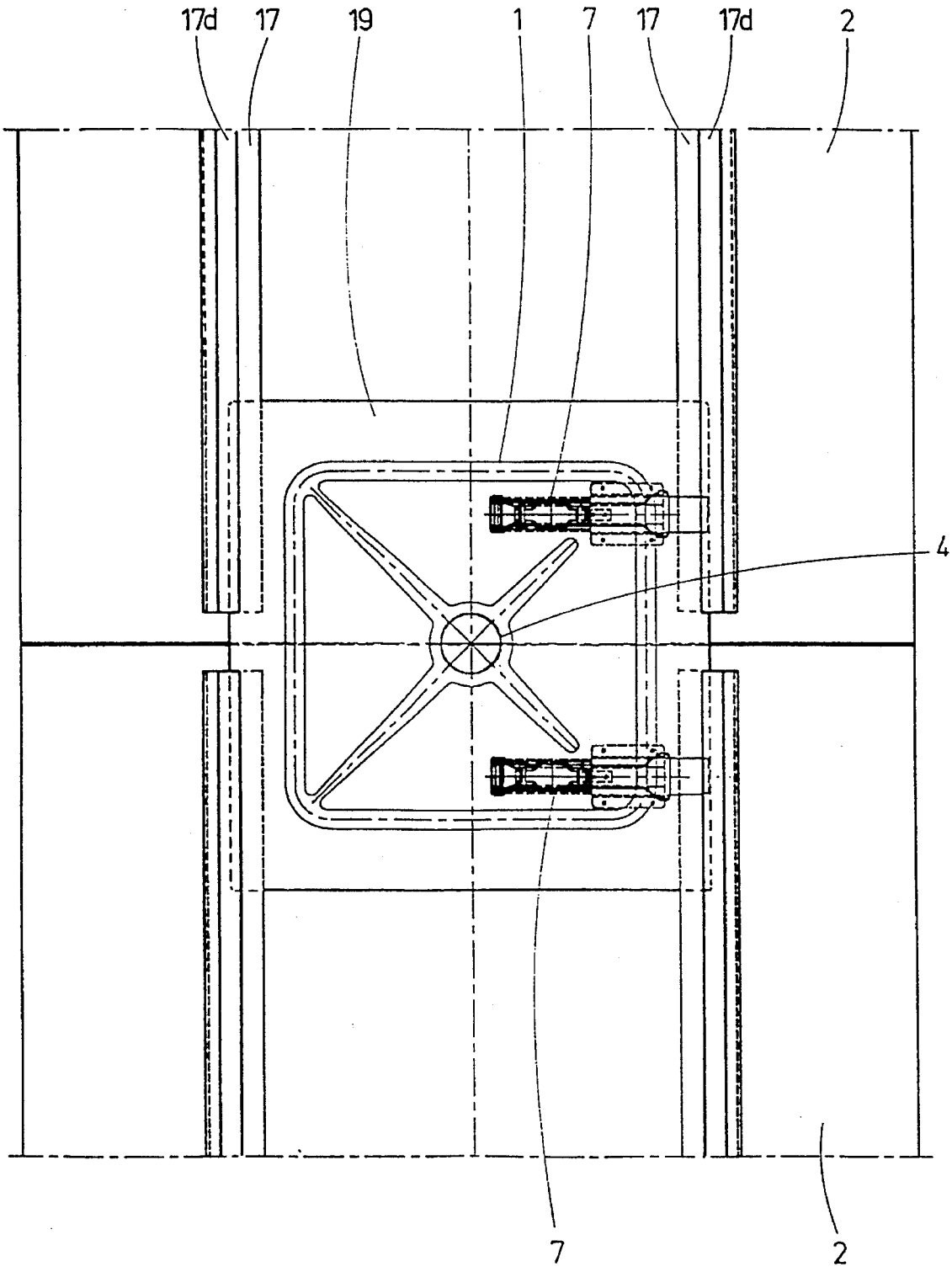
FIG. 12 is the lower view of two tabletops connected with one another by an underframe.

FIG. 12 shows the connection of two tabletops 2 by mounting plate 19 of a underframe 1.

Figure 13:
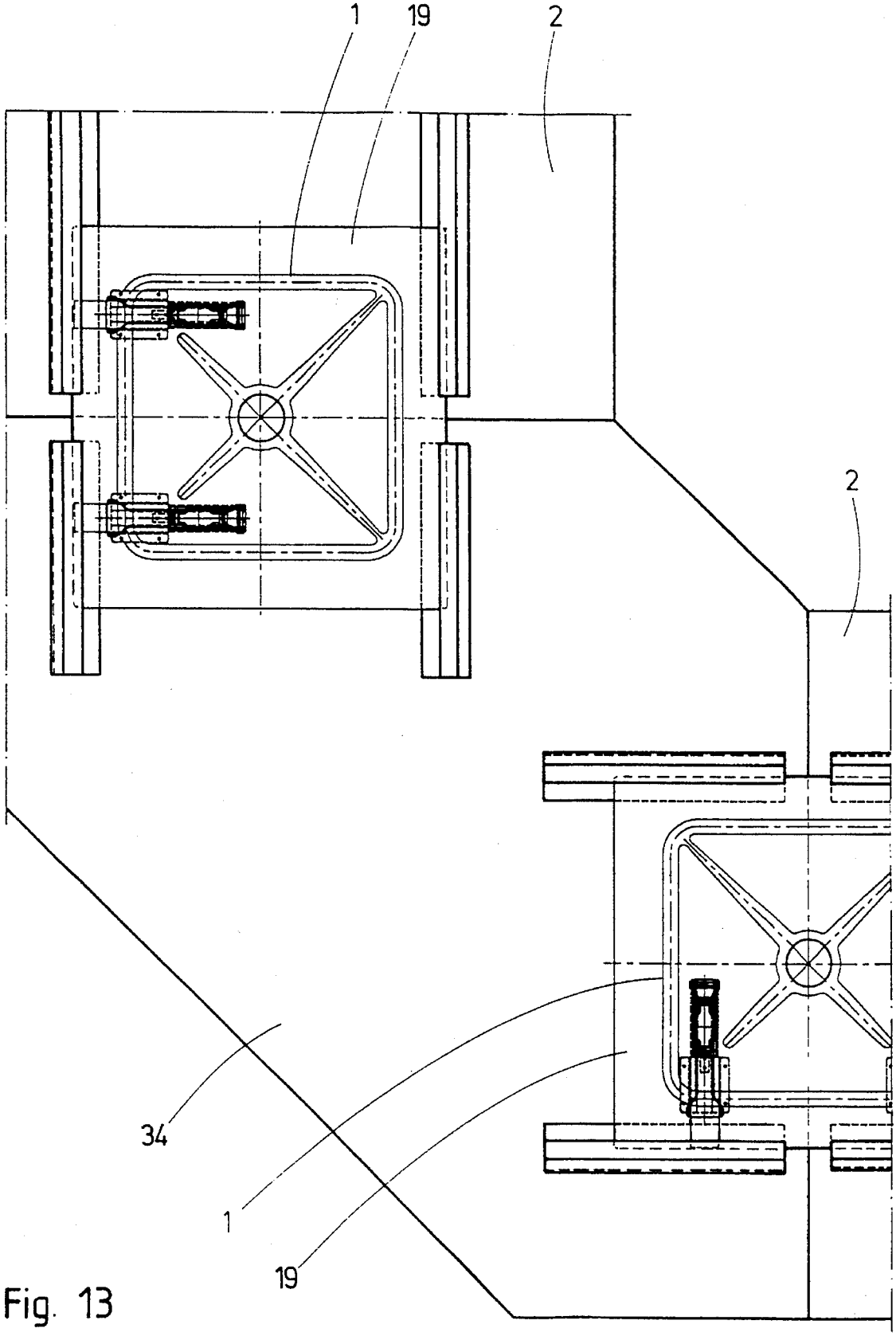
FIG. 13 is the lower view of a comer tabletop over 90°, which is connected by the mounting plates of two underframes with two rectangular tabletops mounted at a right angle to one another.

FIG. 13 represents a corner tabletop 34, which is connected by two mounting plates 19 with two rectangular or square tabletops 2 installed at a right angle to one another.

I claim:

1. An underframe for tabletops for single and multiple tables, comprising at least one leg or pedestal attached to a mounting plate fastened under the tabletop; mounting rails (6) arranged on an underside (5) of a said tabletop (2) at a distance from and parallel to one another, the mounting rails (6) being adapted to be engaged with the mounting plate (3), and clamping devices (7) to clamp said mounting plate (3) firmly on at least one said mounting rail (6), said mounting rails (6) having a Z-profile and legs (8) of said mounting rails (6) being directed inwardly toward one another and forming gaps (9) with said tabletop underside (5) to hold two opposite edges (3*a*, 3*b*) of said mounting plate (3).

2. Underframe according to claim 1, wherein said mounting rails (6) have a reinforcing leg (16) bent downwardly from said leg (8).

3. Underframe according to claim 1, wherein said mounting rails (6) end shortly before tabletop edges (10) and wherein ends (11) of said mounting rails (6) are folded under to avoid leg injuries.

4. Underframe according to claim 1, wherein said clamping devices (7) are clamping disks (12) with an S-profile, which are pivotally mounted on an edge section (3*c*) of said mounting plate (3) connecting to at least one extending edge (3*a*, 3*b*), which is arranged at a distance under said tabletop (3) and are attached on one end (14) which is guided through said mounting plate (3) and is fixed in it, of a pivot lever (13) for rotation of said clamping disks (12) from a release position (12') into a clamping position (12") in a gap (9) between said tabletop underside (5) and said leg (8) of said mounting rail (6), said at least one extending edge (3*a*, 3*b*) of said mounting plate (3) in an area of rotation of said lever having recesses (15) corresponding to said clamping disks (12).

5. Underframe according to claim 4, wherein the clamping disks (12) have an oval shape.

6. An underframe for tabletops for single and multiple tables, comprising at least one leg or pedestal attached to a mounting plate fastened under the tabletop; mounting rails (17) arranged on an underside (5) of said tabletop (2) at a distance from and parallel to one another, the mounting rails (17) being adapted to be engaged with the mounting plate (19), and clamping devices (7) to clamp said mounting plate (14) firmly on at least one said mounting rail (17), said mounting rails (17) being L-profile rods for the short reinforcing leg (17*a*) and a long holding leg (17*b*) secured to said table underside (5) and including clamping members (17*c*, 17*d*), said clamping members (17*c*, 17*d*) pointing toward a center of the tabletop and said holding leg (17*b*) forming a slot (18) that opens toward said center of the tabletop and that receives edges of said mounting plate, a locking rod (21) movable into and out of said slot (18), means (20, 33) for moving said locking rod (21) into and out of said slot (18), said locking rod (21) having a clamping end (22) which, when inserted into said slot (18) wedges between an outer edge (19*a*) of said mounting plate (19) and said clamping members (17*c*, 17*d*) releasably to urge said outer edge (19*a*) into locked position against an underside of said holding leg (17*b*).

7. Underframe according to claim 6, wherein said clamping end (22) of said locking rod (21) is designed as a clamping ring.

8. Underframe according to claim 6, wherein said mounting plate (19) has a central section (19*b*) which merges into two edge sections (19*c*) directed obliquely upward, pointing outward, of which in each case said outer edge (19*a*) is offset, and wherein at least one said edge section (19*c*) of said mounting plate (19) has a number of through-openings (24) corresponding to the number of said clamping devices (7) for said locking rods (21) of said clamping devices (7).

9. Underframe according to claim 6, there being two said locking rods (21) arranged on said mounting plate (19).

10. Underframe according to claim 6, wherein a lever (25) is attached with its end (28) facing away from a connecting hinge (26) of two levers (25, 27) of said moving means (20, 33) at a fixed point (29) to a top side (30) of said mounting plate (19), and wherein said locking rod (21) can move in a slide bar (32) on the top side (30) of said mounting plate (19) and is connected to an end (31) of the other said lever (27) facing away from said connecting hinge (26).

11. Underframe according to claim 6, wherein said mounting rails (17) are extruded steel or aluminum profiles.

* * * * *